US005200782A

United States Patent [19]

Castelli et al.

[11] Patent Number: 5,200,782

[45] Date of Patent: Apr. 6, 1993

[54] DISTURBANCE ISOLATION IN A BELT RECEPTOR OF A COLOR PRINTER

[75] Inventors: Vittorio R. Castelli, Yorktown Heights, N.Y.; Stephen T. Chai, Rancho Palos Verdes, Calif.

[73] Assignee: Xerox Corporation, Stamford, Conn.

[21] Appl. No.: 786,685

[22] Filed: Nov. 1, 1991

[51] Int. Cl.[5] ..... G03G 5/00

[52] U.S. Cl. ..... 355/212; 355/271

[58] Field of Search ..... 355/212, 210, 211, 271; 226/195; 346/160.1, 139 R, 118

[56] References Cited

U.S. PATENT DOCUMENTS

| | | | |
|---|---|---|---|
| 3,656,674 | 4/1972 | Morse | 226/195 X |
| 3,732,402 | 5/1973 | Boyer | 226/195 X |
| 4,003,742 | 1/1977 | Jackson et al. | 355/212 |
| 4,110,027 | 8/1978 | Sato et al. | 355/274 |
| 4,279,496 | 7/1981 | Silverberg | 355/212 |
| 4,869,707 | 9/1989 | In 't zandt et al. | 355/212 X |

*Primary Examiner*—A. T. Grimley
*Assistant Examiner*—Nestor R. Ramirez
*Attorney, Agent, or Firm*—Oliff & Berridge

[57] ABSTRACT

A belt receptor module for a color printer isolates disturbances such as impulsive and high-frequency force disturbances caused by entrance of a recording medium into a transfer nip of a transfer station. The belt receptor module includes a belt receptor positioned about a plurality of spaced rollers. A transfer station is located adjacent an area of the belt receptor. A tension roller is located adjacent the belt receptor on either side of the transfer station. The tension rollers each articulate about an appropriate axis to enable the belt receptor to enter a subsequent roller at angle of approximately 90° to its axis without generating lateral forces. Each tension roller is movable along a different line to create a tension level therein, each tension level being different from the other tension level. The tension levels generated by the tension rollers do not substantially change with the position of said rollers and, thus, provide relief from the impulsive and high-frequency force disturbance caused by the entrance of a recording medium into a transfer nip of the transfer station. The isolation of the disturbance enables proper registration of the color separations while avoiding motion-induced artifacts.

17 Claims, 1 Drawing Sheet

DISTURBANCE ISOLATION IN A BELT RECEPTOR OF A COLOR PRINTER

BACKGROUND OF THE INVENTION

1. Field of the Invention

The present invention relates to a belt receptor for use in a color printer and, more particularly, to an apparatus for isolating disturbances in a belt receptor of a color printer.

2. Description of the Related Art

In color printing, a plurality of images are recorded and developed on a member such as an electroreceptor belt. Each image corresponds to one of a plurality of colors. For example, red, green and blue images can be recorded and developed on an electroreceptor belt to form three color separations, the three color separations being superimposed to form a single color image.

In a multiple-pass color printer, each of the red, green and blue color separations is transferred from the electroreceptor belt to a recording medium. The transfer is performed such that the three color separations are positioned in superimposed relationship to one another to form the color image.

In single-pass color printers, the red, green and blue color separations are superimposed on the electroreceptor belt prior to transfer to the recording medium. The color separations are superimposed on the electroreceptor belt by successive imaging stations located adjacent the electroreceptor belt. Each imaging station records an image corresponding to one of the colors. The single color image is developed with toner particles of a color complementary thereto prior to transfer to the recording medium. Various recording mediums can be used in conjunction with these color printers such as a sheet of paper, a transparency, etc.

To achieve a quality image which is not blurred in appearance and which does not contain unwanted artifacts, the color separations must be accurately provided in superimposed relationship while avoiding any motion-induced image degradation. Accordingly, the motion of the electroreceptor belt must be finely controlled, particularly in the span of the electroreceptor belt which encompasses the imaging and developing stations forming the images.

The transfer of an image to a recording medium is performed at a transfer station having a transfer nip. Often, as the recording medium enters the transfer nip, an impulsive and high-frequency force disturbance occurs which is commonly called "thumping". This disturbance impairs the fine control of the motion of the electroreceptor belt which is required to achieve proper tone uniformity and relative registration of the color separations. Because of frequency bandwidth limitations, this disturbance cannot be corrected by known servo mechanism technology. Such servo mechanism technology enables correction only of slowly and smoothly varying force disturbances introduced by other process components such as cleaners, etc.

U.S. Pat. No. 3,656,674 to Morse discloses a web tension isolator for isolating a web within a particular area of a web advancing mechanism from tension forces acting on the web in other regions of the web advancing mechanism. On each side of the isolated portion of the web, a freely rotatable pulley mounted on a pivoted arm interacts with a driver pulley to keep the ratio of the tensions in the web on each side of the pulleys substantially constant. The region of the web between the pairs of pulleys is thus isolated from web tension fluctuations.

U.S. Pat. No. 3,732,402 to Boyer discloses an electromechanical device for a tape winding mechanism wherein vibrations and pulley arrangements are reduced to a maximum extent possible. In the tape winding mechanism, a shock absorber and tensioning device are disposed on each side of a tape reading area to prevent harmful vibration. The shock absorber devices comprise a pair of coil springs connected between a pair of actuating solenoids and a pivot arm. Each pivot arm supports a roller which bears against the tape.

The above references do not disclose belt receptor modules which can achieve the fine control required to obtain proper relative registration of color separations as a recording medium enters the transfer nip.

OBJECTS AND SUMMARY OF THE INVENTION

An object of the present invention is to provide an apparatus which isolates disturbances in a belt receptor of a color printer.

Another object of the present invention is to provide an apparatus which accurately controls the motion of a belt receptor in a color printer, particularly upon entrance of a recording medium into a transfer station.

Another object of the present invention is to provide a belt receptor in a color printer which corrects for impulsive and high-frequency force disturbances.

A further object of the present invention is to provide a belt receptor in a color printer which avoids motion-induced image degradation and achieves proper relative registration between color separations.

To achieve the foregoing and other objects and to overcome the shortcomings discussed above, a belt receptor module for a color printer is provided which isolates disturbances in a such a manner that impulsive and high-frequency force disturbances caused by entrance of a recording medium into a transfer nip of a transfer station are prevented from adversely affecting the smoothness and uniformity of motion in the imaging and development areas. The belt receptor module includes a belt receptor positioned about a plurality of spaced rollers. A transfer station is located adjacent an area of the belt receptor. A tension roller is located adjacent the belt receptor on either side of the transfer station. The tension rollers each articulate about an appropriate axis located upstream and oriented at approximately 90 degrees to the plane of the belt receptor incoming span and through the center of its width, thus not generating lateral forces. Each tension roller is separately actuated to create a tension level therein, each of the tension levels being different from the other tension level. The low stiffness and the low inertia of the tensioning mechanisms provide relief from the impulsive and high-frequency force disturbance caused by the entrance of a recording medium into the transfer nip of the transfer station. The isolation of the disturbance enables proper relative registration of the color separations in the imaging and development spans of the belt receptor loop while avoiding motion-induced artifacts.

BRIEF DESCRIPTION OF THE DRAWING

The invention will be described in detail with reference to the following drawing wherein.

DETAILED DESCRIPTION OF PREFERRED EMBODIMENTS

Figure 1:
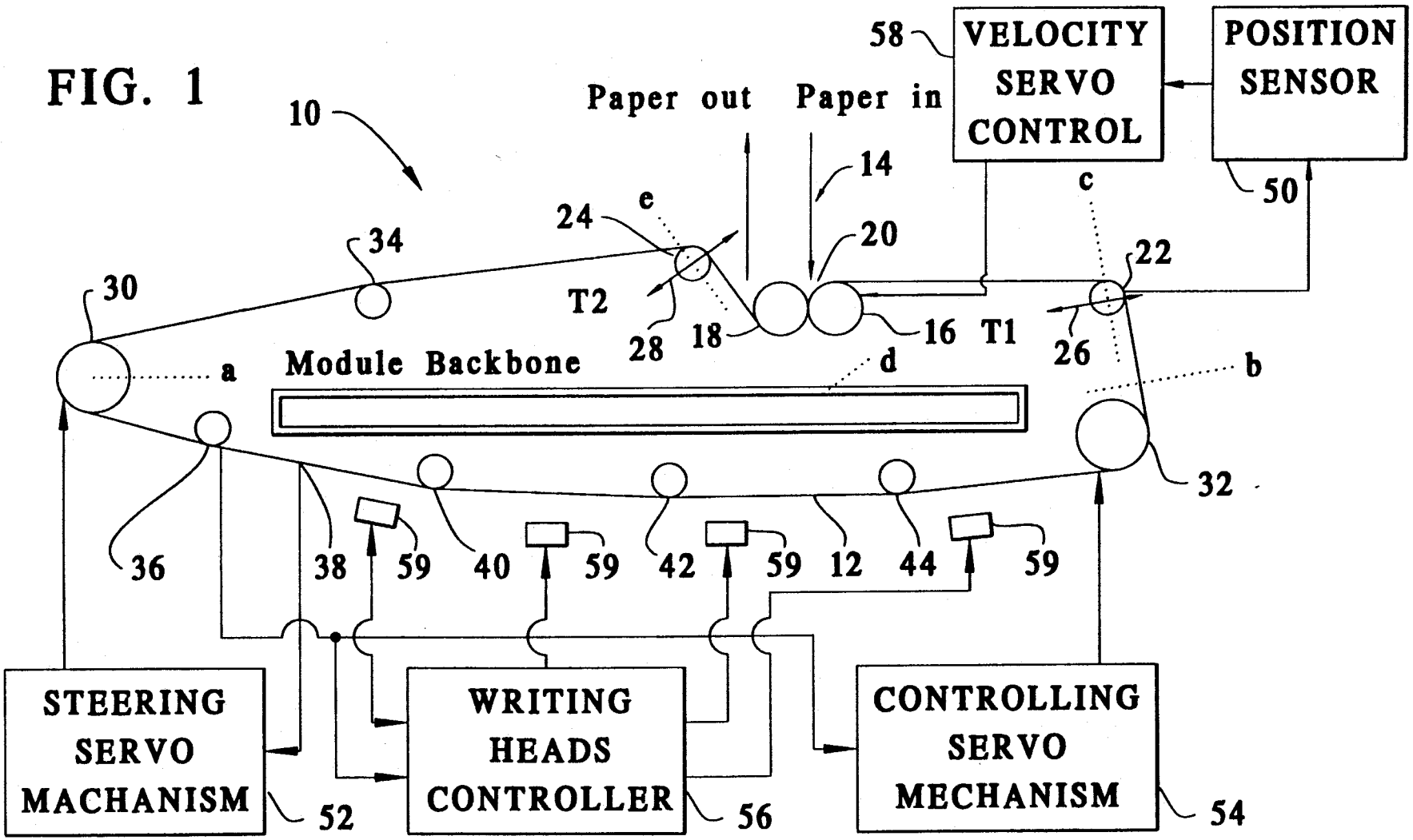
FIG. 1 is a schematic diagram of a belt receptor module which isolates disturbances in accordance with the present invention.

Referring now to FIG. 1, a belt receptor module 10 which isolates disturbances is described. Belt receptor module 10 includes a belt receptor 12 such as an electroreceptor belt upon which images are provided as belt receptor 12 passes successive imaging and development stations. Once images are formed on belt receptor 12, the images are transferred to a recording medium at transfer station 14. Transfer station 14 commonly includes a transfer backup roller 16 and a transfer pinch roller 18. The recording medium is introduced to a transfer nip 20 between transfer backup roller 16 and transfer pinch roller 18. The recording medium passes through transfer nip 20 around transfer pinch roller 18 and exits transfer station 14.

As the recording medium enters transfer nip 20, an impulsive and high-frequency force disturbance called "thumping" commonly occurs. The belt receptor module 10 of the present invention provides relief for this commonly occurring high-frequency force disturbance.

Belt receptor module 10 includes a pair of tension rollers 22 and 24, tension rollers 22 and 24 being positioned adjacent belt receptor 12 on either side of the transfer backup roller 16 and transfer pinch roller 18, respectively, of transfer station 14. Tension rollers 22 and 24 and transfer station 14 define an isolation span of belt receptor module 10.

Tension roller 22 is able to move in the direction of solid double arrow 26. Tension roller 22 is acted upon, in the direction of solid double arrow 26, by a "soft" force of such magnitude to create a tension T1 in a span of belt receptor 12 between a drive roller 32 (to be described herein below) and transfer backup roller 16. The term "soft", as it is used here, denotes the fact that the mechanism producing the force exhibits very little stiffness, that is, the force it produces does not change appreciably in magnitude when the tension roll is displaced from its equilibrium position. A typical tension force could be between approximately 15 and 50 lbs. A typical excursion of the tension rollers as a result of the entrance of a recording medium into transfer nip 20 would be from approximately 0.010 to 0.050 in. The force variation due to the excursion would have to be less than 1% through the full range of motion.

The position of tension roller 22 is sensed by a position sensor 50 which must have an output exhibiting a smooth, but not necessarily very accurate, relation with the roller displacement. Accordingly, when an electrical voltage is provided as output of position sensor 50, it is important that the voltage variation with position be smooth. The sensed position is used as feedback to a velocity servodrive of tension backup roller 16. This device is designed to adjust the speed of the belt receptor at transfer in such a manner as to maintain the tension roller 22 in approximately the same position. This adjustment must be performed smoothly and slowly in order not to create dynamic forces in the belt receptor which may disturb its motion in the imaging and development spans.

Tension roller 22 further freely articulates about a rotation axis c, thus enabling belt receptor 12 to approach transfer backup roller 16 at an angle of approximately 90° to the axis of rotation b of transfer backup roller 16. By these means, the angle of approach of belt receptor 12 to transfer backup roller 16 becomes automatically 90 degrees, and the tendency of belt receptor 12 to move laterally if belt receptor 12 approaches transfer backup roller 16 so that its direction of motion is not perpendicular to the rotation is resisted. Accordingly, no lateral forces are generated as belt receptor 12 approaches transfer backup roller 16.

Tension roller 22 can optionally freely articulate about rotation axis b to render tension roller 22 self-aligning. Tension roller 22 and its actuating mechanism are preferably of low mass in order to prevent the transmission of the "thump" disturbance of the transfer pinch to the imaging and development span of belt receptor module 10. The mass must be sufficiently low to produce an acceptably small force when multiplied by the acceleration, generally approximately 0.02 to 0.10 G (G denoting the acceleration of gravity), induced on tension roller 22 by the entrance of a recording medium into transfer nip 20. The acceptably small force does not cause a drive roller 32 (to be described herein below) to alter its motion. A total mass of tension roller 22 of less than one pound is typically required in order to maintain the forces well below one once.

A second tension roller 24 positioned adjacent to and downstream of transfer pinch roller 18 can move in the direction of solid double arrow 28. Tension roller 24 is acted upon, in the direction of solid double arrow 28, by a "soft" (as described herein above) force of such a magnitude to provide a tension T2 in the span of belt receptor 12 between transfer pinch roller 18 and steering roller 30 (as described herein below).

Tension roller 24, similar to tension roller 22, has a low mass in order that motion of tension roller 24 will prevent the transmission of any "thump" disturbance of the transfer pinch roller 18 to the imaging and development span of belt receptor module 10.

Tension roller 24 further freely articulates about rotation axis e, thus enabling belt receptor 12 to approach a wrap on steering roller 30 at an angle of approximately 90° to the axis of rotation of steering roller 30. This free articulation about rotation axis e prevents lateral forces from being generated as belt receptor 12 approaches steering roller 30. Tension roller 24 can optionally further freely articulate about rotation axis d, thus rendering tension roller 24 self-aligning.

Tensions T1 and T2 of tension rollers 22 and 24, respectively, may be controlled such that the levels of tensions T1 and T2 are different. Accordingly, if the magnitude of T2 is larger than that of T1, a net forward force is generated by the driving means of the transfer pinch 18 such that it balances the drag force due to friction in said pinch 18, thus facilitating the operation of drive roller 32 with a minimum of power.

Belt receptor module 10 includes a plurality of elements located adjacent belt receptor 12 in an area exterior to the isolation span and between tension rollers 22 and 24.

An idler roller 34 is provided which facilitates definition of the span geometry of belt receptor 12 for a cleaning apparatus, idler roller 34 supporting belt receptor 12 in the region of the cleaning apparatus.

Steering roller 30 articulates around an axis which bisects the belt receptor wrap angle in the approximate center of the width of belt receptor 12 under the control of a positioning servo mechanism 52, the axis being substantially perpendicular to the roller spin axis. A lateral sensor 38 preferably tracks the edge of belt receptor 12 to provide an error signal as feedback to the steering servo mechanism 52. The positioning servo mechanism 52 of steering roller 30 operates at a very slow reaction rate (in technical terms called "low bandwidth"), e.g., the frequency represented by one cycle every ten belt revolutions, so that edge irregularities tracked by lateral sensor 38 are not followed, such edge irregularities not being representative of the behavior of the bulk of belt receptor 12.

An encoder roller 36, illustrated as being positioned between steering roller 30 and lateral sensor 38, tracks the motion of belt receptor 12 in a process direction on the belt receptor 12 to provide motion and registration information to drive roller 32 and its controlling servo mechanism 54. Encoder roller 36 can further provide motion and registration information to the writing heads controller 56 and writing heads 59 which generate the latent images on belt receptor 12. As encoder roller 36 measures the motion of belt receptor 12, encoder roller 36 can pass the measured information to a system which times the writing by writing heads 56. If motion irregularities can be compensated for by appropriate timing variations, the production of artifacts is avoided.

Encoder roller 36 rides as an idler on belt receptor 12 with sufficient angle of wrap to easily overpower the friction of its bearings. A known angle encoder can be mounted on the axis of encoder roller 36. Due to the fact that essentially no torque acts on encoder roller 36, the motion of belt receptor 12 is properly measured.

Blotter backup rollers 40, 42 and 44 can optionally be provided in spaced position adjacent belt receptor 12. Blotters are used to pick up excessive liquid developer fluid from belt receptor 12. Each blotter presses an external roller coated with a sponge-like material against belt receptor 12 backed up by an internal idler roller. This constitutes a pinch. The blotting action requires high forces. If the pinch forces applied to the belt receptor 12 by the blotters and the blotter backup rollers 40, 42 and 44 are high, blotter backup rollers 40, 42 and 44 should be of a self-aligning type.

Drive roller 32 is fixed in its orientation, drive roller 32 providing smooth velocity and accurate position with respect to time of belt receptor 12. Drive roller 32 provides the necessary traction force to counteract time variable drag in the span of belt receptor 12 from steering roller 30 to drive roller 32. The mean drag of the span of belt receptor 12 from steering roller 30 to drive roller 32 and the drag of the rest of the loop of belt receptor module 10 is neutralized by the balancing of tensions T1 and T2 described above. Imaging and development stations are located in the span between drive roller 32 and steering roller 30.

Transfer backup roller 16 has a fixed axis, transfer backup roller 16 being driven by a low bandwidth velocity servo control 58 which uses the position of tension roller 22 provided by position sensor 50 as feedback signal. The torque not provided by drive roller 32 is provided by transfer backup roller 16. The servo control 58 of transfer backup roller 16 need not be very accurate. The servo control must only be relatively smooth so as to maintain tension roller 22 in an acceptable range of positions.

Transfer pinch roller 18 is able to move a slight amount laterally so as to load and unload the transfer pinch. The wrap of transfer pinch roller 18 is of an extent sufficient to enable cooling of the image transferred from belt receptor 12 to a recording medium.

The above described structure of belt receptor module 10 enables the elimination of the effects of force disturbances caused by entrance of a recording medium into transfer nip 20, thus relieving the "thumping" problem generated as the recording medium enters transfer nip 20. The color separations can thus be accurately superimposed on belt receptor 12 while avoiding motion-induced image degradation and concurrently achieving proper relative registration. The structure of belt receptor module 10 enables fine control of the motion of belt receptor 12 in the span encompassing the imaging and developing stations.

While this invention has been described in conjunction with a specific embodiment thereof, it is evident that many alternatives, modifications and variations will be apparent to those skilled in the art. Accordingly, the preferred embodiment of the invention as set forth herein is intended to be illustrative, not limiting. Various changes may be made without departing from the spirit and scope of the invention as defined in the following claims.

What is claimed is:

1. An apparatus for isolating disturbances in a belt receptor module of a color printer, said belt receptor module having a transfer station at which an image is transferred from a belt receptor in said belt receptor module to a recording medium, said apparatus comprising:

a pair of spaced tension rollers by which said belt receptor passes, one of said tension rollers being located at a position adjacent one side of said transfer station and the other of said tension rollers being located at a position adjacent an opposite side of said transfer station such that said tension rollers and said transfer station define an isolation span of said belt receptor module, said one tension roller being movable along a first line to create a first tension level in said belt receptor, said other tension roller being movable along a second line different from the first line to create a second tension level in said belt receptor, said first and second tension levels being different, wherein said transfer station comprises a transfer backup roller and a transfer pinch roller, said belt receptor passing over said transfer backup roller, between said transfer backup and pinch rollers, and under said transfer pinch roller, said apparatus further comprising sensor means for sensing the position of said one tension roller, said sensor means providing an output signal indicating the position of said roller.

2. The apparatus according to claim 1, further comprising drive means for driving said transfer backup roller, said sensor means providing feedback to said drive means.

3. The apparatus according to claim 1, wherein said one tension roller freely articulates about an axis which is substantially perpendicular to its axis of rotation and parallel to the direction of motion of the belt receptor in its incoming span.

4. The apparatus according to claim 1, wherein said one tension roller freely articulates about a rotational axis which is substantially perpendicular to the plane of the receptor belt in its incoming span and is located upstream of said other tension roller to render said one tension roller self-aligning.

5. The apparatus according to claim 1, wherein said tension rollers have a low mass.

6. The apparatus according to claim 1, wherein said transfer station comprises a transfer backup roller and a transfer pinch roller arranged in a pinch configuration, said one tension roller being located adjacent to and upstream of said transfer backup roller and said other tension roller being located adjacent to and downstream of said transfer pinch roller.

7. The apparatus according to claim 6, wherein said transfer backup roller has a fixed axis.

8. The apparatus according to claim 6, wherein said transfer pinch roller moves in a lateral direction with respect to said transfer backup roller so as to apply a pinch force on the receptor belt.

9. The apparatus according to claim 1, wherein said other tension roller freely articulates about axis which is substantially perpendicular to its axis of rotation and parallel to the direction of motion of the belt receptor in its incoming span.

10. The apparatus according to claim 1, wherein said other tension roller freely articulates about a rotational axis which is substantially perpendicular to the plane of the receptor belt in its incoming span and is located down stream of said one tension roller to render said other tension roller self-aligning.

11. The apparatus according to claim 6, wherein said belt receptor module includes lateral sensing means for sensing lateral movement of said belt receptor, said lateral sensing means being positioned adjacent said belt receptor exterior to the isolation span, said lateral sensing means providing a signal indicative of the sensed lateral movement.

12. The apparatus according to claim 11, wherein said belt receptor module includes a steering roller positioned adjacent to said belt receptor at a location exterior to said isolation span, said steering roller steering said belt receptor, a positioning means driving said steering roller around a rotation axis substantially bisecting the angle of wrap of the belt receptor on said steering roller, said positioning means receiving the signal from said lateral sensing means.

13. The apparatus according to claim 1, wherein said belt receptor module includes a drive roller positioned adjacent to said belt receptor at a location exterior to said isolation span, said drive roller imparting smooth velocity and accurate positioning with respect to time of the belt receptor.

14. The apparatus according to claim 13, wherein said belt receptor module includes an encoder roller having an angular encoder mounted coaxial therewith positioned adjacent to said belt receptor at a location exterior to said isolation span, said encoder roller tracking the motion of said belt receptor, said encoder roller providing motion and registration information to said drive roller.

15. The apparatus according to claim 1, wherein said belt receptor module includes an idler roller positioned adjacent to said belt receptor at a location exterior to said isolation span, said idler roller defining a span geometry of the belt receptor.

16. The apparatus according to claim 1, wherein said belt receptor module includes at least one blotter backup roller positioned adjacent to said belt receptor exterior to said isolation span.

17. The apparatus according to claim 16, wherein said at least one blotter backup roller is self-aligning to correct for the application of pinch forces thereagainst.

* * * * *